United States Patent [19]

Nakamura et al.

[11] Patent Number: 4,738,211

[45] Date of Patent: Apr. 19, 1988

[54] SEWING MACHINE CONTROL DEVICE

[75] Inventors: Takashi Nakamura; Satomi Yamauchi; Hiroshi Kumatani; Masakatsu Daijo, all of Aichi, Japan

[73] Assignee: Mitsubishi Denki Kabushiki Kaisha, Tokyo, Japan

[21] Appl. No.: 932,559

[22] Filed: Nov. 20, 1986

[30] Foreign Application Priority Data

Nov. 20, 1985 [JP] Japan ..... 60-260353

[51] Int. Cl.[4] ..... D05B 69/18

[52] U.S. Cl. ..... 112/277

[58] Field of Search ..... 112/277, 275, 220, 221, 112/271; 318/326, 327, 328

[56] References Cited

U.S. PATENT DOCUMENTS 4,080,914 3/1978 Ishida et al. ..... 112/277

4,183,312 1/1980 Angersbach et al. ..... 112/277

OTHER PUBLICATIONS

Dohi et al., "Device for Driving a Sewing Machine", WO85/03958, 9-1985.

*Primary Examiner*—Peter Nerbun

*Attorney, Agent, or Firm*—Sughrue, Mion, Zinn, Macpeak & Seas

[57] ABSTRACT

A sewing machine controller in which initially a rotation transfer ratio is calculated from the number of rotations of a motor and the detected number of rotations of the sewing machine shaft. Thereafter, the number of motor rotations is calculated as the product of the rotation transfer ratio and the desired number of rotations of the sewing machine.

2 Claims, 4 Drawing Sheets

SEWING MACHINE CONTROL DEVICE

BACKGROUND OF THE INVENTION

1. Field of the Invention

This invention relates to a sewing machine control device for controlling the number of rotations a sewing machine for a given sewing operation so as to maintain a correct, predetermined number.

2. Background of the Invention

Generally, many electro-motive type sewing machines driven by motors are used for industrial sewing machines. In the sewing machine of this type, the rotation of the motor is transferred to the shaft of the sewing machine by means of pulleys and a belt so as to rotate and drive the shaft. Published unexamined Japanese Patent Application No. 33979/1983 discloses a conventional sewing machine control device, in which an alternating current motor is used as the motor, and the number of rotations of the motor is changed by a method for controlling the frequency of the electric power supplied to the motor or by other methods in order to control the number of rotations of the shaft of the sewing machine.

In this prior art open-loop type sewing machine in which the number of rotations of the sewing machine is not fed back to the motor drive controller, however, the number of rotations of the motor is set to a predetermined number in order to control the number of rotations of the sewing machine with a constant rotation transfer ratio being assumed. Therefore, the prior art includes the problem that the sewing machine is not correctly controlled when the pulleys are changed and the rotation transfer ratio is changed.

SUMMARY OF THE INVENTION

Accordingly, an object of this invention is to solve the above problem.

More specifically, an object of the invention is to provide a sewing machine control device in which the number of rotations of the sewing machine is not changed even when the rotation transfer ratio is changed.

According to the present invention the rotation transfer ratio is obtained from the number of rotations of the motor and the number of rotations of the sewing machine.

The number of rotations of the sewing machine is always made to be a predetermined number by compensating the number of rotations of the motor even when the rotation transfer ratio is changed.

BRIEF DESCRIPTION OF THE DRAWING

In the accompanying drawings.

DETAILED DESCRIPTION OF THE PREFERRED EMBODIMENTS

Figure 1:
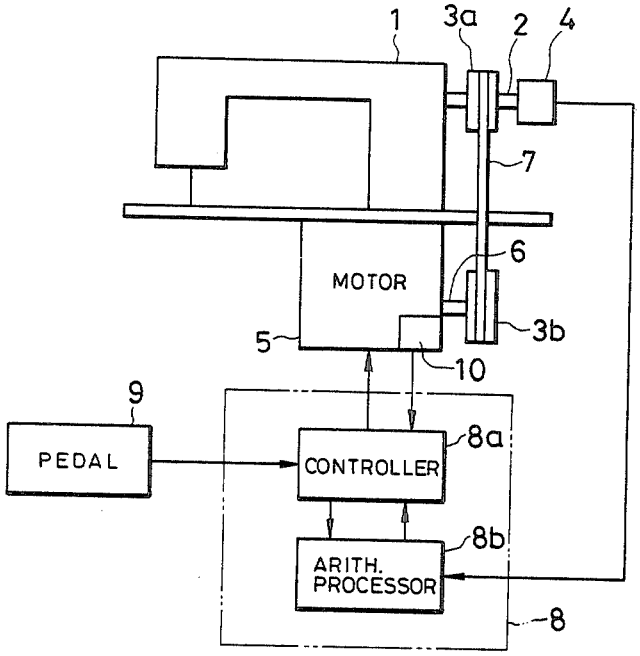
FIG. 1 is a block diagram showing an embodiment of the invention.

In FIG. 1 which is a block diagram showing one embodiment of the invention, a pulley 3*a* rotates with the shaft 2 of a sewing machine 1, and a rotation detecting means 4 detects the number of rotations of the shaft 2. A pulley 3*b* rotates with the rotation shaft 6 of a three-phase AC variable speed motor 5, and a belt 7 transfers the rotation of the pulley 3*b* to the pulley 3*a* of the sewing machine 1. A sewing machine controller 8 comprises a controller 8*a* and an arithmetic processor 8*b*. When a pedal 9 is treadled, the controller 8*a* drives the motor 5 at a low speed for 0.5 to 1 revolution, and a motor rotation detector 10 supplies a signal representing the number of rotations of the driven motor 5 to the arithmetic processor 8*b* through the controller 8*a*. When a signal, described hereiunder, representing the rotation transfer ratio is supplied to the controller 8*a* from the arithmetic processor 8*b*, during actual operation, a driving signal is supplied to the motor 5 so as to rotate the motor shaft 6 for a predetermined number of rotations on the basis of the signal representing the rotation transfer ratio. The signal representing the number of the rotations of the driven motor shaft 6 is supplied to the arithmetic part 8*b* from the motor shaft rotation detector 10. The arithmetic processor 8*b* generates the signal representing the rotation transfer ratio on the basis of the signal representing the number of rotations of the motor 5 and a signal representing the number of rotations of the sewing machine 1 from the detecting means 4.

The operations of the device constituted as described above are explained hereinunder. First, when the pedal 9 is treadled, the controller 8*a* supplies a signal to the motor 5 to be rotated at the low speed, and the motor shaft rotation detector 10 supplies the signal representing the number of rotations of the driven motor 5 to the arithmetic processor 8*b*. Therefore, the motor 5 is driven and rotated at the low speed for 0.5 to 1 revolution. The rotation of the motor shaft 6 is transferred to the shaft 2 of the sewing machine 1 through the pulley 3*b*, the belt 7 and the pulley 3*a* to rotate the shaft 2 of the sewing machine 1. The detecting means 4 generates the signal representing the actual number of revolutions of the shaft 2, and this signal is supplied to the arithmetic processor 8*b*.

The number of rotations M of the sewing machine 1 is represented by the following equation multiplying the number of rotations m of the motor shaft 6 by the rotation transfer ratio N.

$$M = N \times m$$

Therefore, since the number of rotations M must be always kept to be a desired actual number, the number of rotations m of the motor shaft 6 must be changed when the rotation transfer ratio N is changed so that the motor 5 is controlled at the currently correct number of rotations $m = M / N$.

Accordingly, as described above, the motor is rotated at the low speed for 0.5 to 1 revolution when the sewing machine is started while the rotational number signals from both the detecting means 4 and the controller 8*a* are obtained and supplied to the arithmetic processor 8*b* to operate thereupon and provide the actual rotation transfer ratio N of the pulleys 3*a* and 3*b*. And then, when the ratio N obtained by the arithmetic processor 8*b* is supplied to the controller 8*a*, the controller 8*a* controls the number of rotations of the motor shaft 6 to be $m=M/N$, and drives the sewing machine. Thereafter, the above operations are performed at the start of the motor 5, and the number of rotations m is controlled in accordance with the ratio N when the ratio N is changed. Consequently, the sewing machine is always operated at a predetermined number of rotations.

In general, the maximum rotation speed of the drive motor 5 is about 3,000 to 4,000 r.p.m. However, it may be required to drive the sewing machine at 10,000 r.p.m., for this purpose and the maximum rotation speed of the motor 5 is varied by changing at least one of the pulleys 3*a* and 3*b* to vary the rotation transfer ratio N of the pulleys 3*a* and 3*b*.

Another purpose of changing the pulleys 3*a* and 3*b* is to select the rotation torque of the motor or the sewing machine 1. A torque required for the motor 5 is changeable with respect to the rotation transfer ratio. More specifically, in the case where the outer diameter of the pulley 3*a* is larger than that of the pulley 3*b*, the torque required for the motor 5 is relatively small. In other words, it is possible to adjust the torque of the sewing machine with the constant maximum torque of the motor 5 by way of changing the rotation transfer ratio.

The operation of the control device will be described in more detail with reference to FIGS. 2 to 5.

Figure 2:
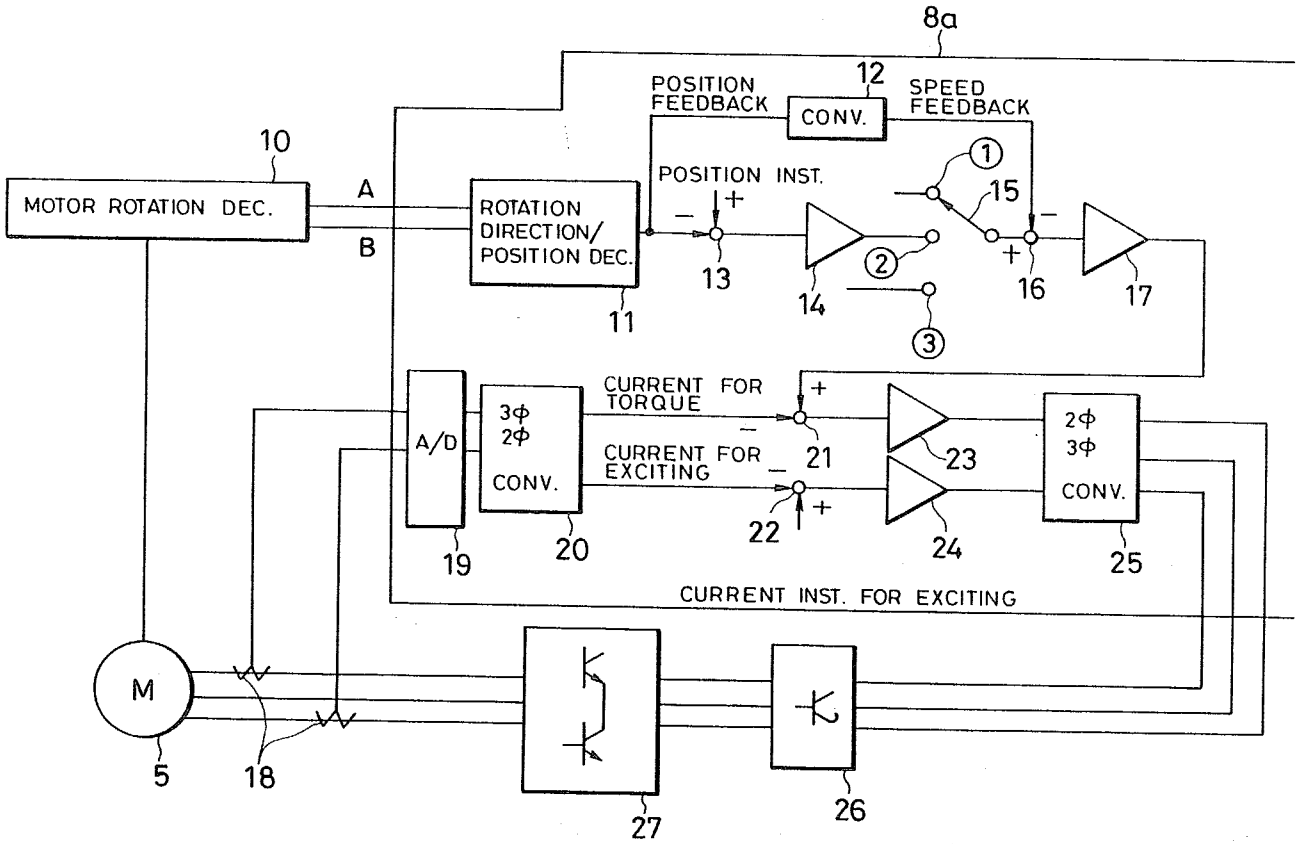
FIG. 2 is a block diagram for the description of a control operation of the present invention in detail.

FIG. 2 is a block diagram showing the sewing machine controller 8 in detail. An ordinary microprocessor is used as the controller 8*a*. As mentioned above, a motor rotation detector 10 detects the number of rotations of the motor 5 to produce pulse signals different by 90° in phase with respect to each other. The detector 10, which is provided in the vicinity of the rotation shafts 6 of the motor 5, operates to produce 500 pulses per one rotation of the motor shaft 6 for instance. The controller 8*a* includes a rotation direction/position detector 11 for detecting the rotation direction and the stop position of the motor shaft 6 based on the output of the detector 10, a converter 12 for converting a position feedback signal to a speed feedback signal, and an adder 13 for adding a stop position instruction signal to the output of the detector 11, so that a sewing needle stops at a position advanced by 15° from the lower dead point. An amplifier 14 amplifies an output of the adder 13 to be applied to the second terminal (2) of a switch 15. The first terminal (1) of the switch 15 receives the speed instruction signal representing a treadle amount of the pedal 9, whereas the third terminal (3) of the switch 15 receives the speed instruction signal produced during an arithmetic operation of the rotation transfer ratio N. An adder 15 is provided to add the speed feedback signal converted by the converter 12 to the speed instruction signal selected by the switch 15, and then the output of the adder 15 is applied through an amplifier 17 to an adder 21. An A/D converter 19 is provided to two of the outputs of an output circuit 27 driven by a drive circuit 26 so that the outputs of a current detector 18 are subjected to an A/D conversion. Reference numeral 20 designates a three-phase to two-phase converter. The adder 21 operates to add the output current signal for torque of the converter 2D to the output of the amplifier 17. An adder 22 operates to add the other output current signal for exciting the converter 20 to a current instruction signal for exciting. The outputs of the adders 21 and 22 are applied to a two-phase to three-phase converter through current amplifiers 23 and 24, respectively. An example of the output circuit 27 is a transistor inverter circuit which is controlled by the drive circuit 26 to thereby carry out the speed control of the variable speed motor 5.

Figure 3A:
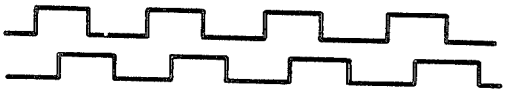
FIG. 3 is a waveform diagram showing an output of a rotation detecting means for a sewing machine and an output of a rotation detecting means for a motor.
Figure 3B:
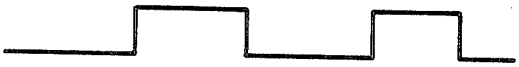

FIG. 3(*b*) shows the output waveform of the detecting means 4. An example of the output signal is a pulse signal having 32 pulses per one revolution of the shaft of the sewing machine 1. The pulse signal also includes signals representing upper and lower dead points in the reciprocating movement of a sewing needle. The position of the sewing needle is detected with reference to these upper or lower dead point signals.

Figure 4:
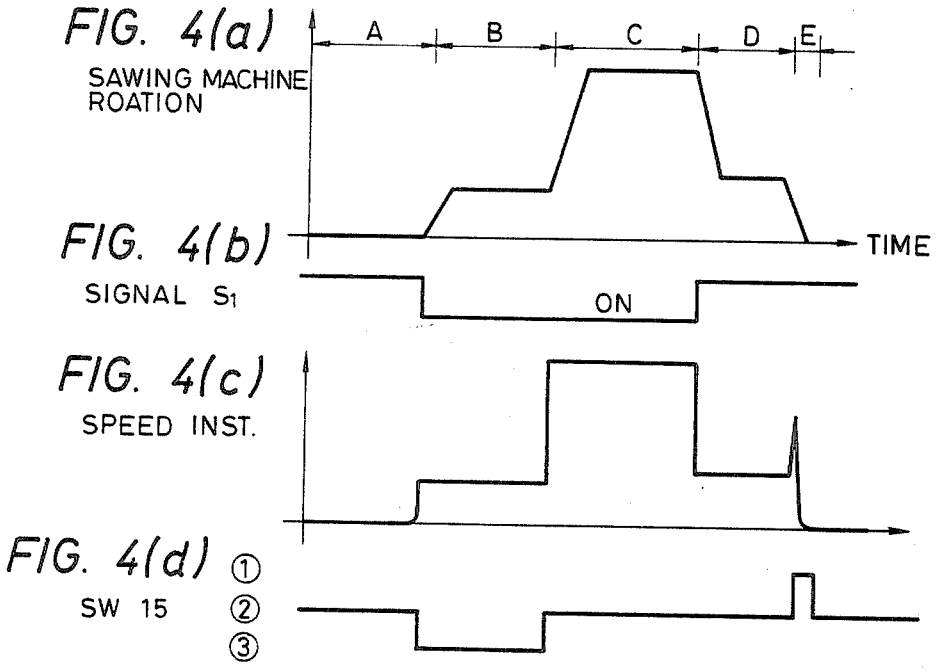
FIG. 4 is a timing chart showing relationships among the number of rotation of the sewing machine, a pedal treading signal, a speed instruction signal and the switching condition of a switch 15.

FIG. 4 is a timing chart showing the operation of the present control device.

As is clear from FIG. 4(*a*), when a power source is coupled to the sewing machine, the motor 5 is maintained stopped (a period of time A).

Then, when the pedal 9 is treadled to put a treadle signal $S_1$ in the ON-state, the motor 5 is driven at a low speed of about 100 to 300 r.p.m. in order to carry out an arithmetic operation for rotation transfer ratio (pulley ratio). During this low speed rotation period indicated by B in FIG. 4(*b*), the number of pulses which are produced by the motor rotation detetor 10 is counter for a certain period of time defined by the predetermined number of pulses produced by the detector 4, so that a rotation transfer ratio N is obtained by a ratio of the thus counted number of pulses and the predetermined number of pulses. It should be noted that, during this period B, the switch 15 is switched so that the signal received by the third terminal (3) thereof is allowed to pass therethrough.

Upon completion of the arithmetic operation for the rotation transfer ratio (pulley ratio) N, the sewing machine is driven at a rotation speed determined by the product of the treadling amount of the pedal 9 and the thus obtained pulley ratio N. Accordingly, the rotation speed of the sewing machine 1 is controlled to be a speed proportional to the treadling amount during a period of time C.

When the treadling of the pedal 9 is suspended, the treadling signal $S_1$ is turned to the OFF-state. The rotation speed of the motor shaft 6 is reduced to the low speed, the same as that in the period of time B, so that the sewing operation to an aimed position is carred out at the low speed during a period of time D.

When the switch 15 is shifted from the terminal (1) to the terminal (2), the position instruction signal is applied to a motor control loop. As a result, the speed instruction signal is produced as shown in FIG. 4(C) and the sewing machine is operated to the final stop position.

Figure 5:
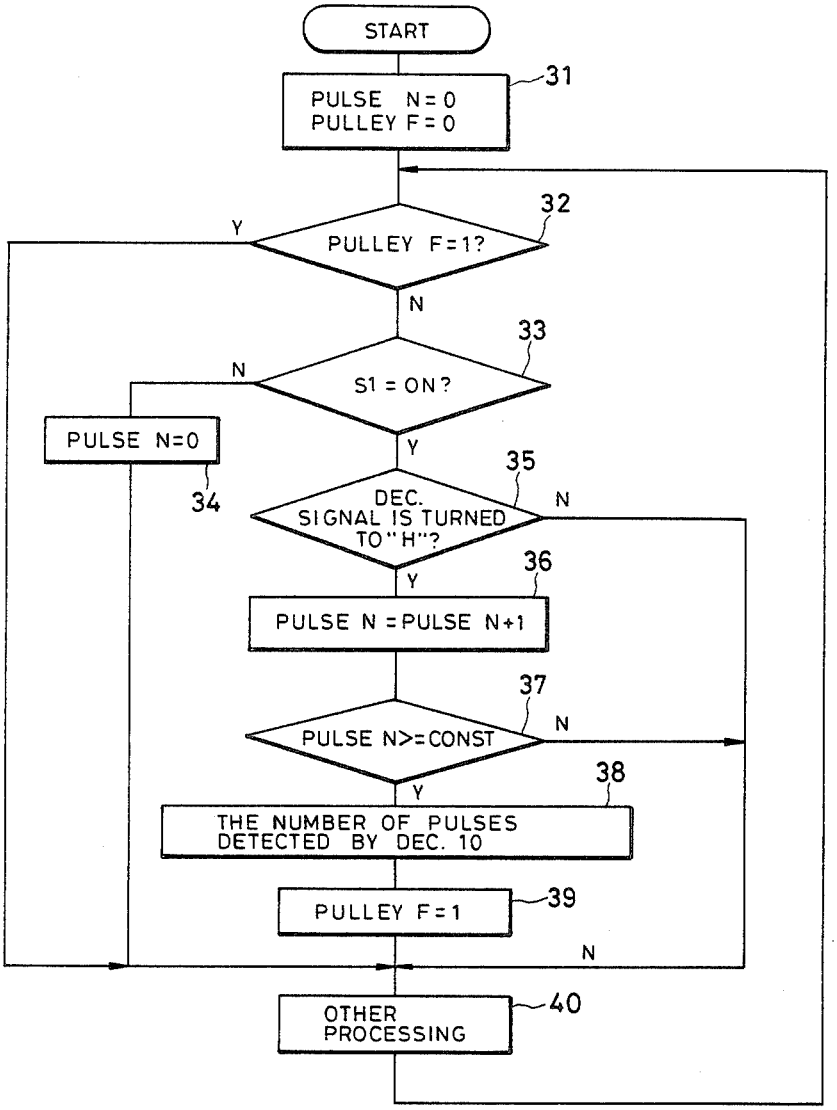
FIG. 5 is a flow chart showing an operation of an arithmetic processor.

FIG. 5 is a flow chart showing the operation of the arithmetic processor 8*b*. In FIG. 5, the term "PULSE N" denotes the number of pulses which are detected by the detector 4. "PULLEY F" is set to "1" after the arithmetic operation for the pulley ratio whereas it is set to "0" before or during the arithmetic operation for the pulley ratio. Further, "K"=(The number of pulses produced by the detector 10)/(The number of pulses produced by the detector 4). "CONST" is a value for determining the number of pulses which are produced by the detector 4 and the arithmetic operation for the rotation transfer ratio (pulley ratio) N accomplished during a period of time corresponding to the thus determined number of pulses.

The operation of the arithmetic processor 8*b* will be described with reference to FIG. 5.

"PULSE N=0" and "PULLEY F=0" are initially set in the step 31, and then it is confirmed in the step 32 whether the arithmetic operation for the rotation transfer ratio N has been accomplished or not. When it is detected that the arithmetic operation has not been accomplished or the arithmetic operation is now being accomplished, the operation step is advanced to the step 33 where it is detected whether the treadle signal S1 is in an ON-state or not. That is, in the step 33, it is detected whether the sewing machine 1 is operated or not. If "no", the operation step is advanced to the step 34 in which "PULSE N" is set equal to "0". On the other hand, if the sewing machine is operated, that is if "YES", it is detected in the step 35 whether the detection signal is at a high level. In case of "YES", "1" is added to the number of pulses which are detected by the detector 4, to obtain "PULSE N" in the step 36. Then, in the following step 37, the thus obtained "PULSE E" is compared with the determined number of pulses, "CONST". If the "PULSE E" is equal to or smaller than the "CONST", the rotation transfer ratio N is calculated in the next step 38. The ratio N is obtained based on the number of pulses which are detected by the detector 4 during a period of time where the determined number of pulses are detected by the detector 10. Thereafter, the "PULLEY F" is set to "1" in the step 39 and the arithmetic operation for the rotation transfer ratio N is completed. Then, the operation step is returned to the step 32 after the other necessary processing.

According to the invention as described above, since the rotation transfer ratio is obtained by utilizing the number of rotations of the motor and that of the sewing machine to control the sewing machine, the number of rotations of the sewing machine is controlled to be a predetermined number at all times by compensating the number of rotations of the motor, so that the sewing machine is correctly controlled.

We claim:

1. A sewing machine control device for controlling a number of rotations of a sewing machine shaft driven by a motor having a motor shaft through rotation transfer means and in accordance with a received instruction, comprising:

means for supplying said instruction indicative of said number of rotations;

first detecting means for detecting a number of rotations of said motor shaft;

second detecting means for detecting a number of rotations of said sewing machine shaft;

arithmetic means for determining a ratio between said number of rotations of said rotor and said number of rotations of said sewing machine shaft during a start-up period of said motor; and control means for controlling a number of rotations of said motor shaft in accordance with said ratio.

2. The sewing machine control device of claim 1, wherein said control means comprises: switching means having a first stationary terminal to which is applied said instruction from said instruction supplying means, and a secondary stationary terminal receiving a second instruction signal indicative of a constant rotational speed of said motor shaft, and a movable terminal set to said second stationary terminal during said start-up period of said motor and at other times to said first stationary terminal.

* * * * *